US011524202B1

(12) United States Patent
Johnson

(10) Patent No.: US 11,524,202 B1
(45) **Date of Patent: *Dec. 13, 2022**

(54) DEVICES FOR REHABILITATING SHOULDER INJURIES

(71) Applicant: William Marshall Johnson, Finville, VA (US)

(72) Inventor: William Marshall Johnson, Finville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/490,386

(22) Filed: Sep. 30, 2021

Related U.S. Application Data

(63) Continuation of application No. 17/215,017, filed on Mar. 29, 2021, now Pat. No. 11,173,338.

(60) Provisional application No. 63/028,039, filed on May 21, 2020.

(51) Int. Cl.
*A63B 21/16* (2006.01)
*A63B 21/00* (2006.01)
*A63B 23/12* (2006.01)

(52) U.S. Cl.
CPC .... *A63B 21/1645* (2013.01); *A63B 21/00047* (2013.01); *A63B 21/4035* (2015.10); *A63B 23/1245* (2013.01)

(58) Field of Classification Search
CPC ..... A63B 21/00047; A63B 21/00185; A63B 21/068; A63B 21/16; A63B 21/1618; A63B 21/1645; A63B 21/1654; A63B 21/1663; A63B 21/4027; A63B 21/4033; A63B 21/4035; A63B 23/12; A63B 23/1245; A63B 2071/0694; A63B 2210/00; A63B 2210/50; A63B 2225/09; A63B 2225/093; A63B 21/4039
See application file for complete search history.

(56) References Cited

U.S. PATENT DOCUMENTS 1,358,564 A * 11/1920 Leonard ..... E06C 1/56 182/196
2,823,918 A * 2/1958 Lewis ..... A63B 23/16 482/37
3,013,799 A * 12/1961 Wise ..... A63B 23/1245 482/118
3,216,030 A * 11/1965 Garfield ..... B63C 9/26 441/84
4,079,811 A * 3/1978 Driskell ..... E06C 9/14 182/35
4,405,034 A * 9/1983 Dunne ..... B63B 27/14 182/100
D313,424 S * 1/1991 High ..... D17/99
5,595,559 A * 1/1997 Viel ..... A61H 1/0237 482/904
5,688,011 A * 11/1997 Gulley ..... B66C 1/18 294/74
5,839,994 A * 11/1998 Elbogen ..... A63B 3/00 482/904

(Continued)

*Primary Examiner* — Gary D Urbiel Goldner
(74) *Attorney, Agent, or Firm* — Michael Haynes PLC; Michael N. Haynes

(57) ABSTRACT

Certain exemplary embodiments can provide a system, machine, device, manufacture that can include, and/or a method for activities that can include and/or relate to, an elongate flexible strap and a plurality of elongate finger steps, each elongate finger step from the plurality of finger steps attached to the strap.

14 Claims, 9 Drawing Sheets

(56) References Cited

U.S. PATENT DOCUMENTS 5,871,422 A * 2/1999 Elbogen ..... A63B 21/1663 482/40
6,158,593 A * 12/2000 Olsen ..... A63B 47/00 206/315.9
6,322,483 B1 * 11/2001 Rotella ..... A63B 21/1654 482/121
D454,235 S * 3/2002 Kaplan ..... D30/153
6,357,551 B1 * 3/2002 Bogardus, III ..... E06C 1/56 182/196
6,450,929 B1 * 9/2002 Markham ..... A63B 21/1645 482/904
7,037,244 B2 * 5/2006 Svihra ..... A63B 23/12 482/93
7,628,740 B2 * 12/2009 Harrington ..... A63B 21/00185 482/121
8,197,392 B2 * 6/2012 Silverman ..... A63B 7/00 482/904
8,696,521 B2 * 4/2014 Wu ..... A63B 7/02 482/904
8,821,359 B1 * 9/2014 Kassel ..... A63B 21/0557 482/904
8,852,058 B1 * 10/2014 Hamberis ..... A63F 9/24 482/44
8,920,294 B2 * 12/2014 Davis ..... A63B 21/1663 482/96
8,944,976 B2 * 2/2015 Crowell ..... A63B 21/00043 482/121
9,003,579 B1 * 4/2015 Pinholster, Jr ..... A45F 3/22 5/120
D753,470 S * 4/2016 Paladino ..... A63B 21/1654 D8/367
D760,503 S * 7/2016 Arguelles ..... D6/315
9,427,622 B2 * 8/2016 Thrasher-Rudd ..... A63B 23/1209
9,630,043 B2 * 4/2017 Foster ..... A63B 21/4021
9,737,744 B2 * 8/2017 Austin ..... A63B 21/4005
9,907,389 B2 * 3/2018 Conlin ..... A45F 3/24
10,035,038 B2 * 7/2018 Prince ..... A63B 21/1636
10,143,612 B2 * 12/2018 Foster ..... A61H 1/0274
D873,505 S * 1/2020 Vilbert ..... B63B 27/14 D30/152
D876,206 S * 2/2020 Pinholster ..... E06C 9/14 D8/356
D895,340 S * 9/2020 Sabbagh ..... A63B 23/1245 D6/718.1
10,786,077 B2 * 9/2020 Dudley ..... A47B 61/003
D911,152 S * 2/2021 Power, II ..... E06C 1/56 D8/356
11,026,417 B2 * 6/2021 Power, II ..... A01M 31/02
11,173,338 B1 * 11/2021 Johnson ..... A63B 21/00047
2003/0078142 A1 * 4/2003 Jacobsen ..... A63B 21/0552 482/126
2003/0158024 A1 * 8/2003 Saure ..... A63B 21/1645 482/129
2004/0248712 A1 * 12/2004 Svihra ..... A63B 21/4035 482/93
2005/0233879 A1 * 10/2005 Harrington ..... A63B 21/00185 482/148
2007/0039781 A1 * 2/2007 Ashmus ..... E06C 9/14 182/196
2011/0269608 A1 * 11/2011 Eubanks ..... A63B 21/1663 482/139
2018/0056110 A1 * 3/2018 Prince ..... A63B 21/4027

* cited by examiner

DEVICES FOR REHABILITATING SHOULDER INJURIES

CROSS-REFERENCES TO RELATED APPLICATIONS

This application claims priority to, and incorporates by reference herein in its entirety, U.S. Provisional Patent Application 63/028,039, filed 21 May 2020.

BRIEF DESCRIPTION OF THE DRAWINGS

A wide variety of potential, feasible, and/or useful embodiments will be more readily understood through the herein-provided, non-limiting, non-exhaustive description of certain exemplary embodiments, with reference to the accompanying exemplary drawings in which.

DRAWING KEY

| Element Name | Element Number |
|---|---|
| Finger-ladder system | 1000 |
| Finger-ladder | 1100 |
| Ladder strap | 1200 |
| Ladder strap top portion | 1210 |
| Ladder strap step portion | 1220 |
| Ladder strap bottom portion | 1230 |
| Strap anchor | 1240 |
| Strap stopper | 1242 |
| Strap knob loop | 1244 |
| Strap hook | 1246 |
| Strap connector | 1248 |
| Strap length adjuster | 1250 |
| Strap variable length section | 1260 |
| Strap extension | 1270 |
| Door | 1300 |
| Doorknob | 1320 |
| Door frame | 1340 |
| Ladder step/rung | 1400 |
| Finger contact surface | 1420 |
| Scale | 1500 |

DESCRIPTION

Figure 1:
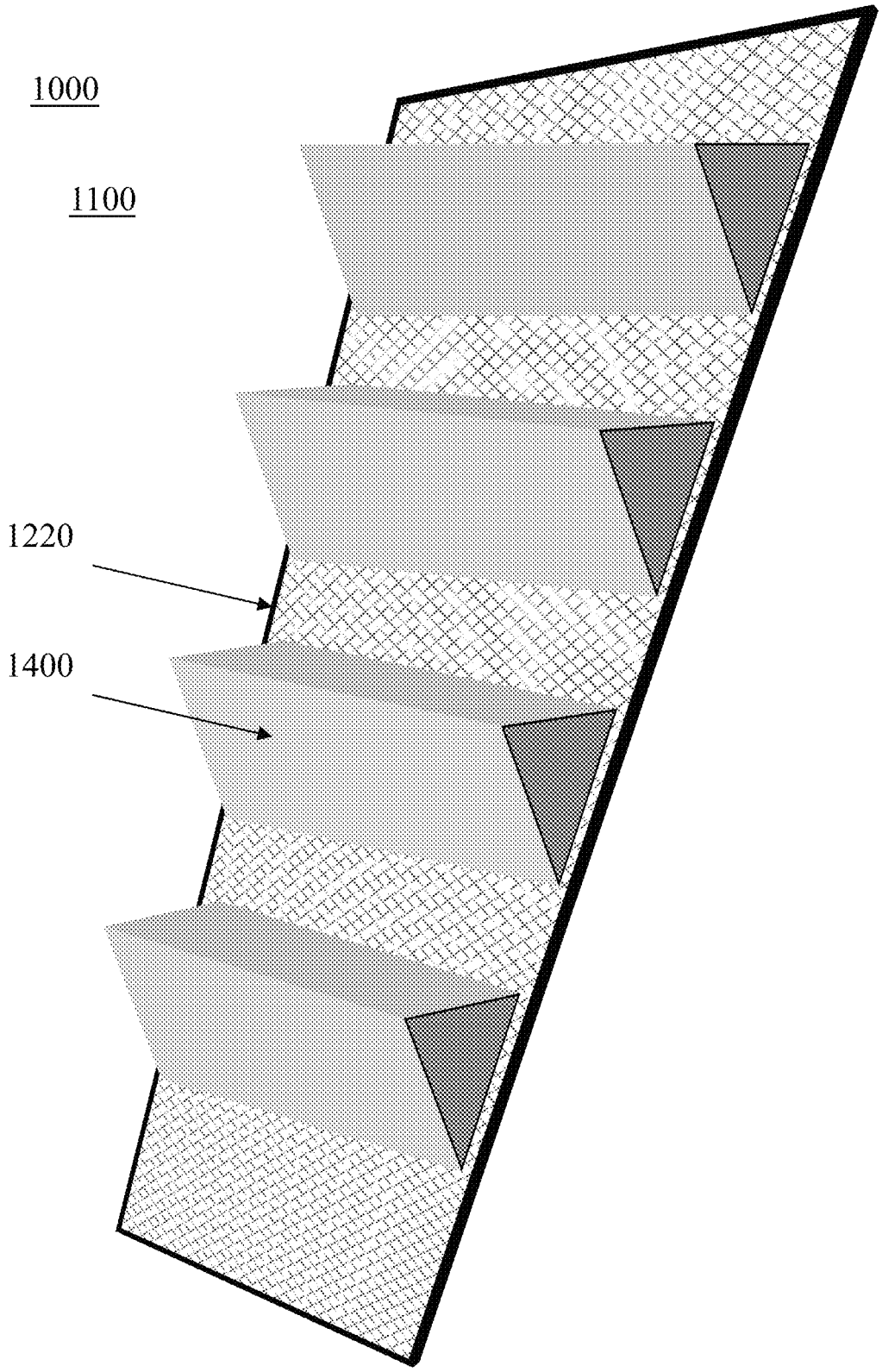
FIG. 1 is a perspective view of an exemplary embodiment of a system and/or device.
Figure 2:
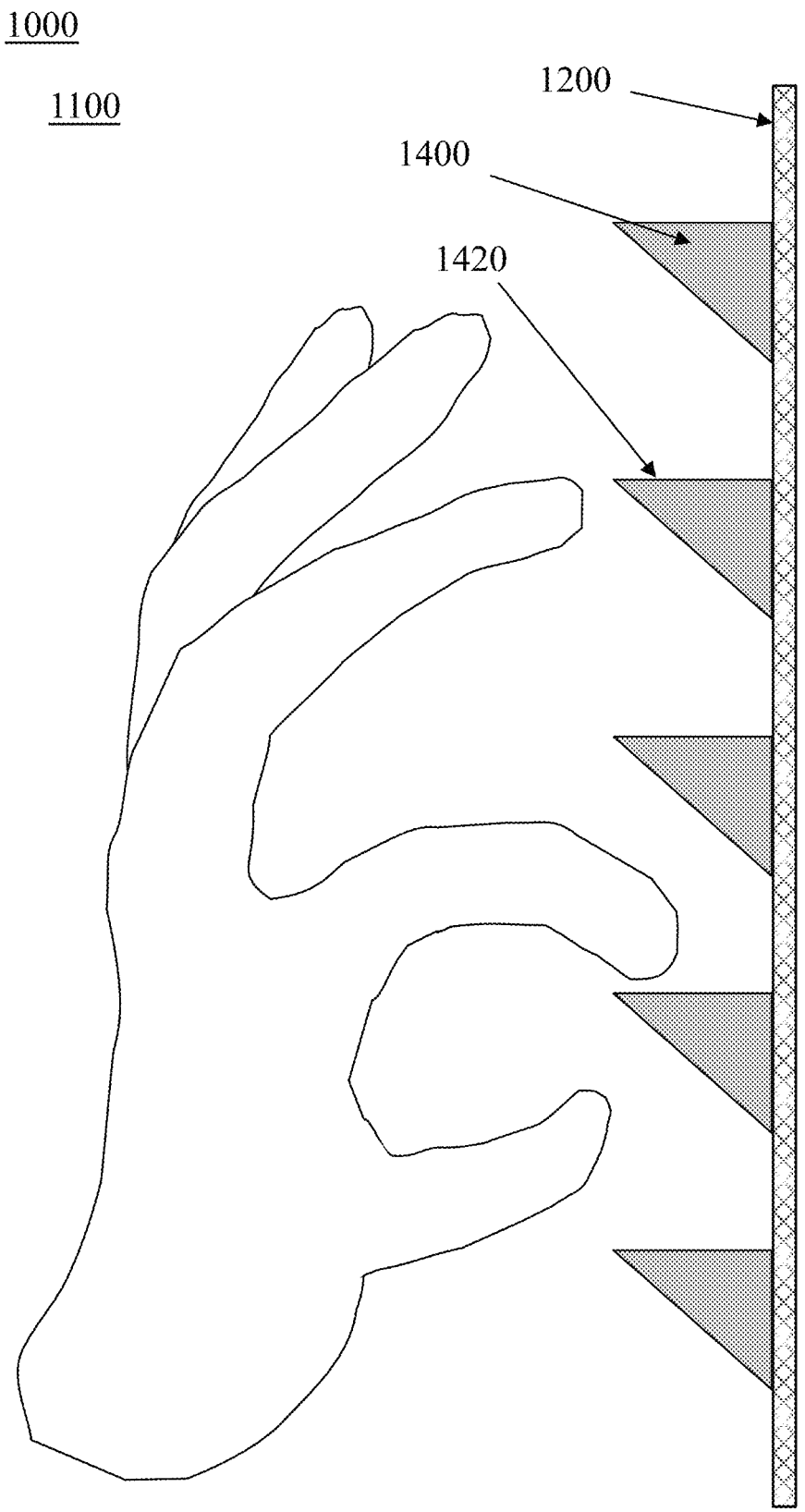
FIG. 2 is a side view of an exemplary embodiment of a system and/or device.
Figures 3, 4:
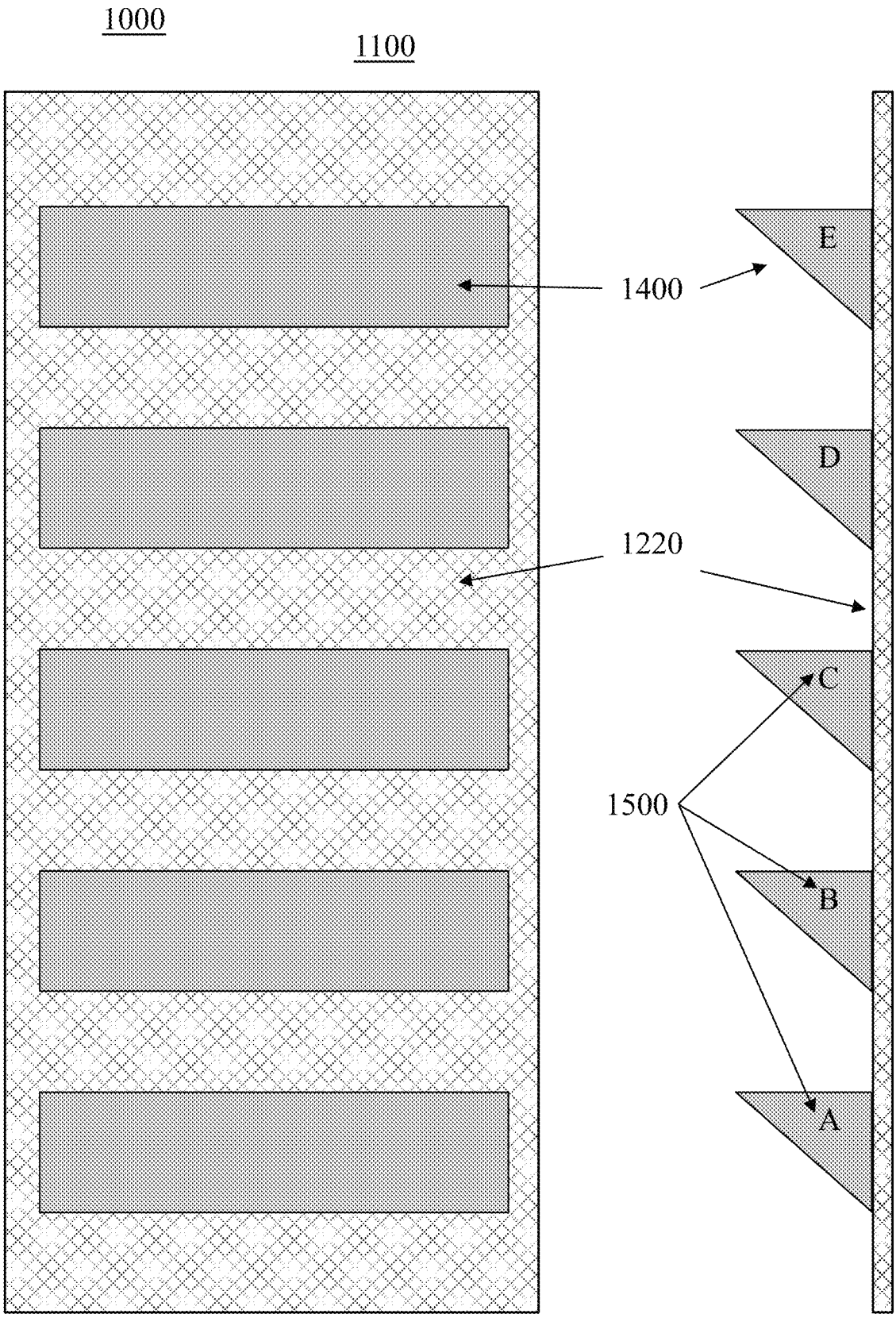
FIG. 3 is a front view of an exemplary embodiment of a system and/or device.
FIG. 4 is a side view of an exemplary embodiment of a system and/or device.
Figure 5:
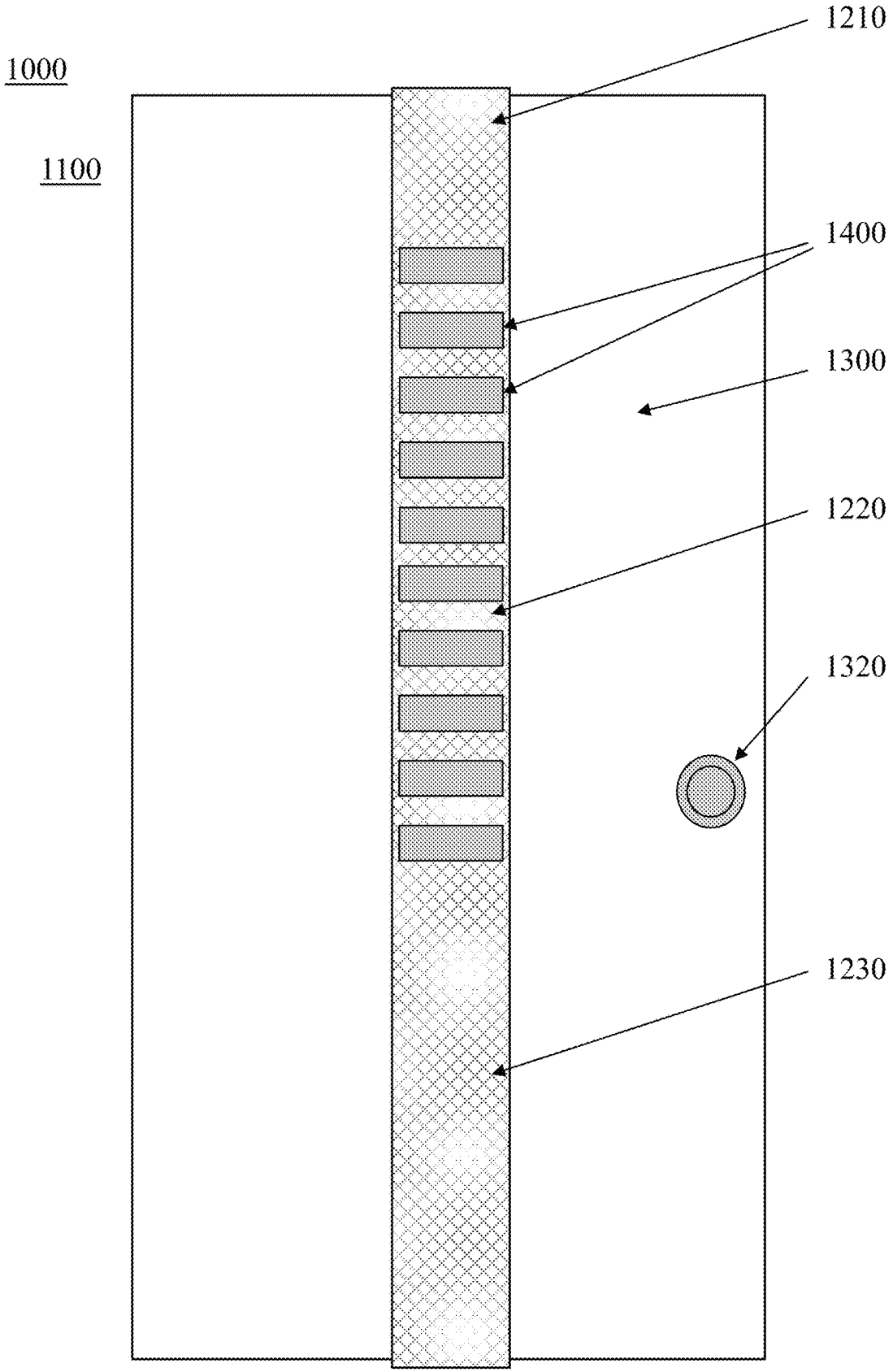
FIG. 5 is a front view of an exemplary embodiment of a system and/or device.
Figure 6:
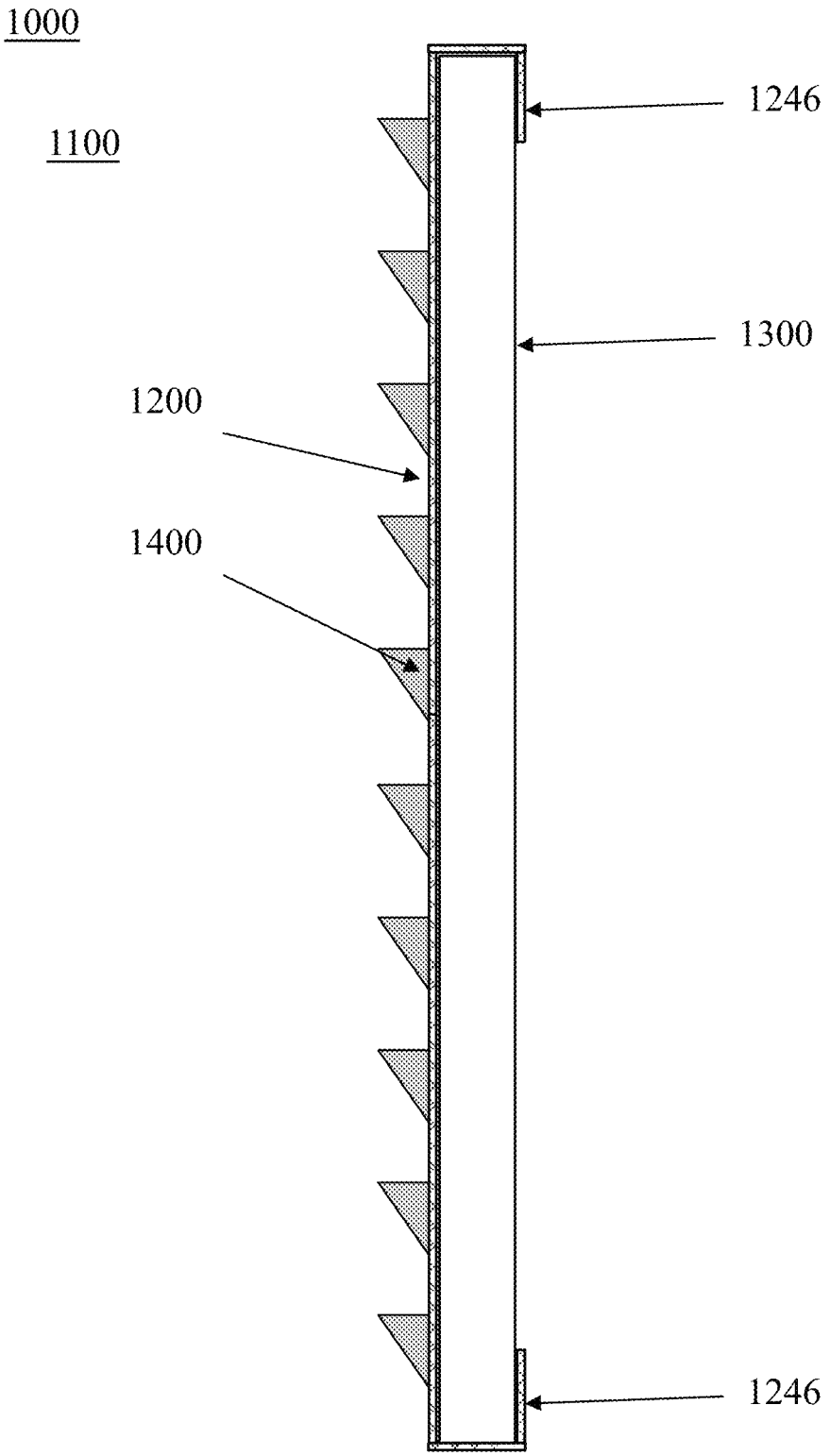
FIG. 6 is a side view of an exemplary embodiment of a system and/or device.
Figure 7:
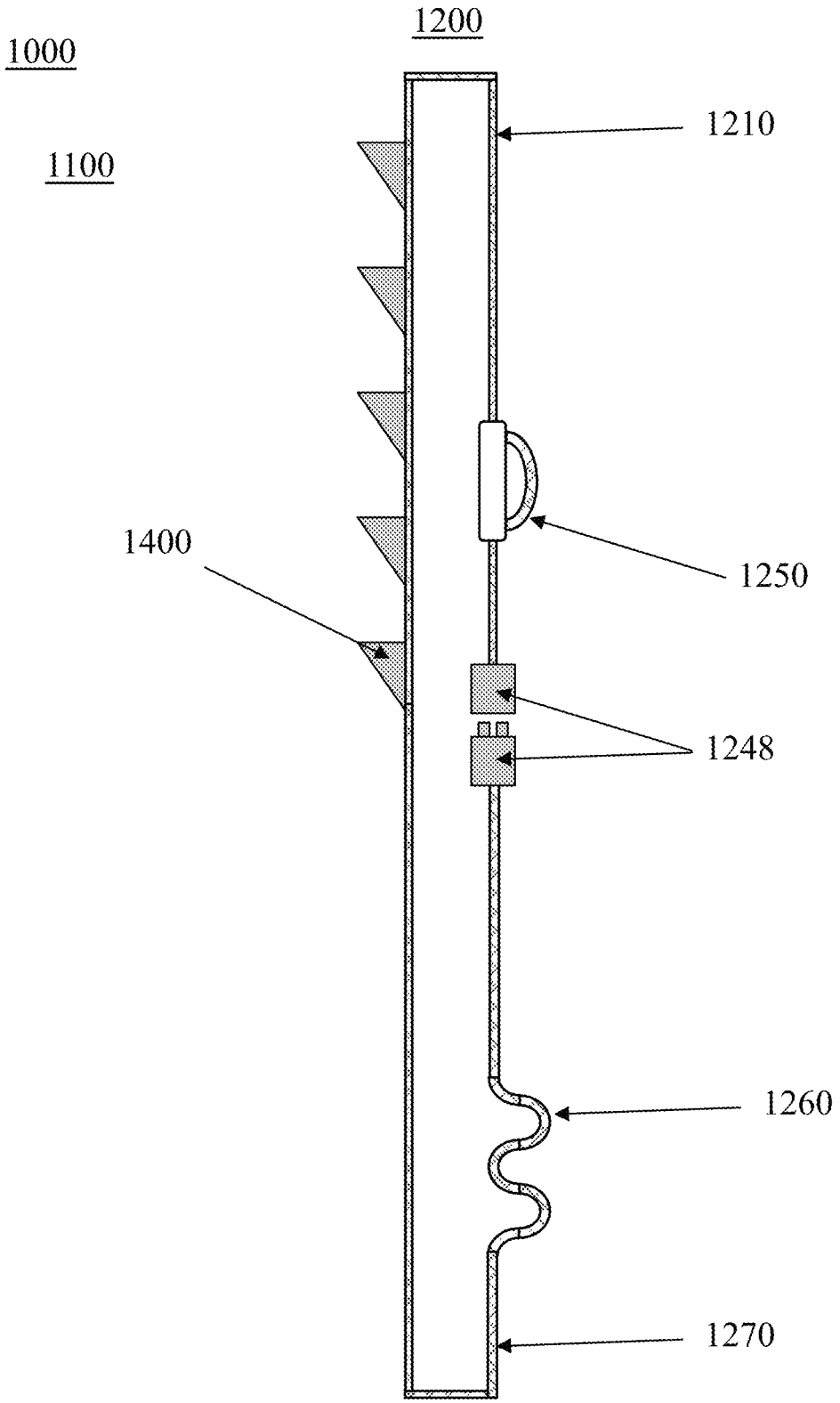
FIG. 7 is a side view of an exemplary embodiment of a system and/or device.
Figure 8:
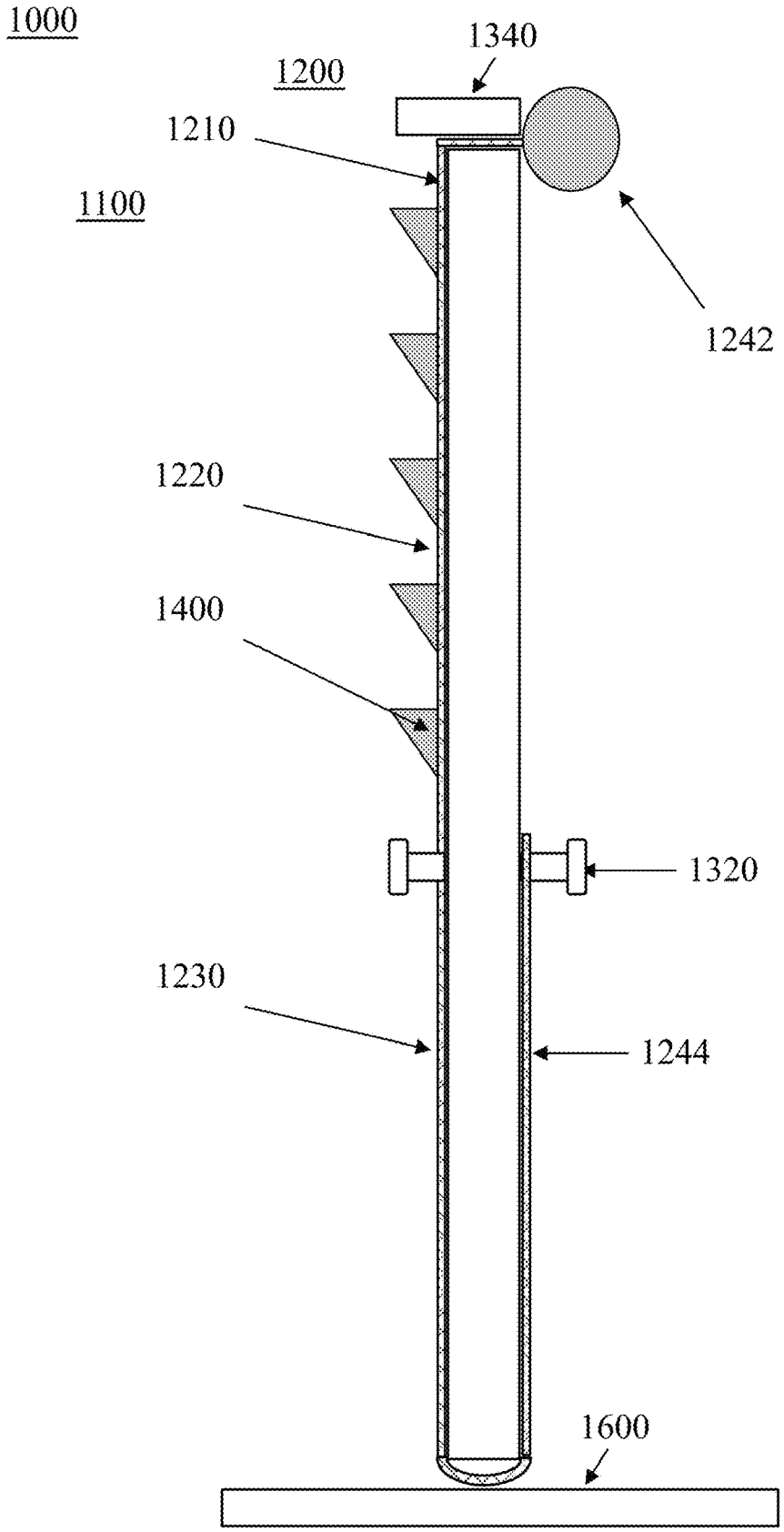
FIG. 8 is a side view of an exemplary embodiment of a system and/or device.
Figure 9:
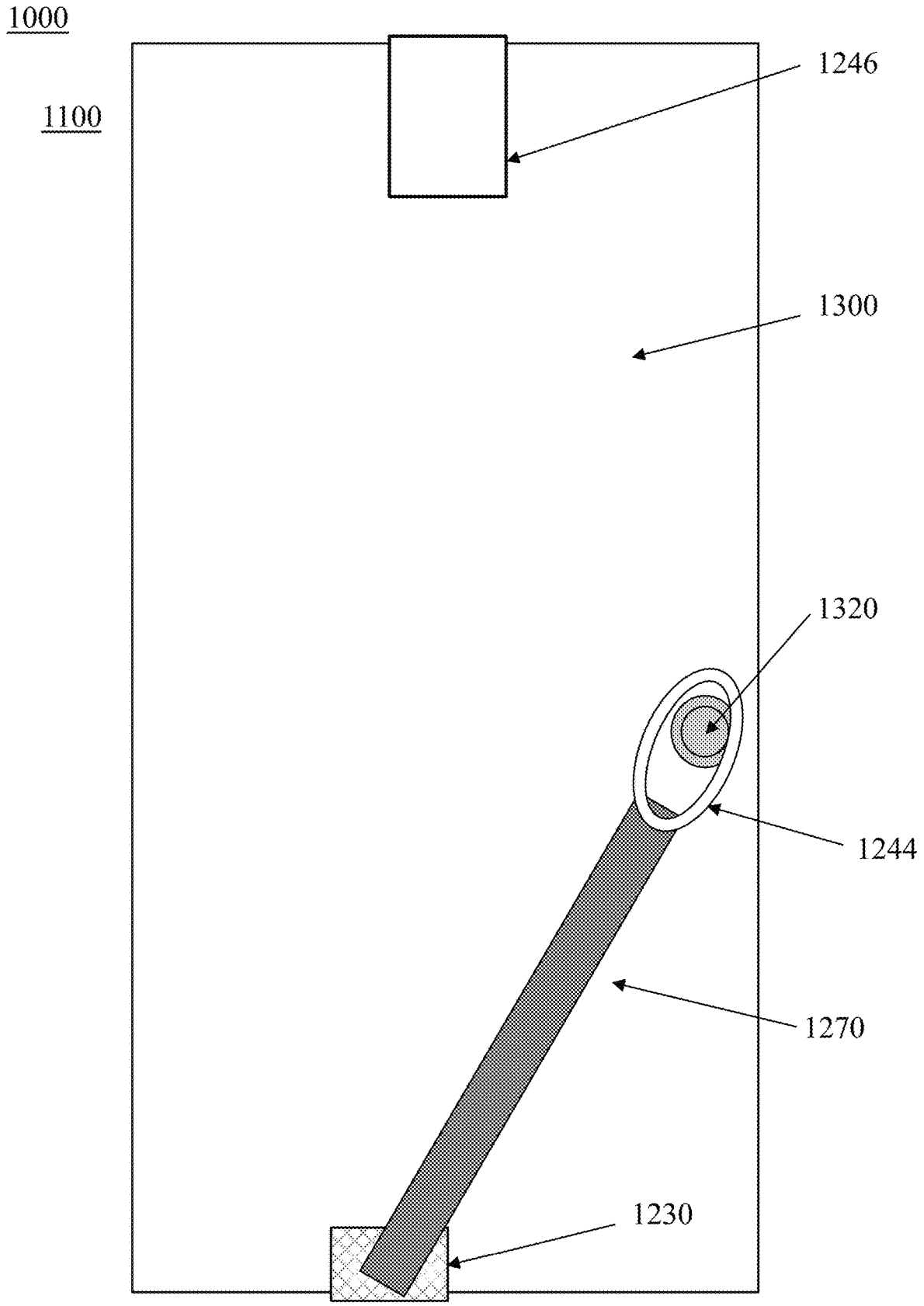
FIG. 9 is a rear view of an exemplary embodiment of a system and/or device.
Figure 10:
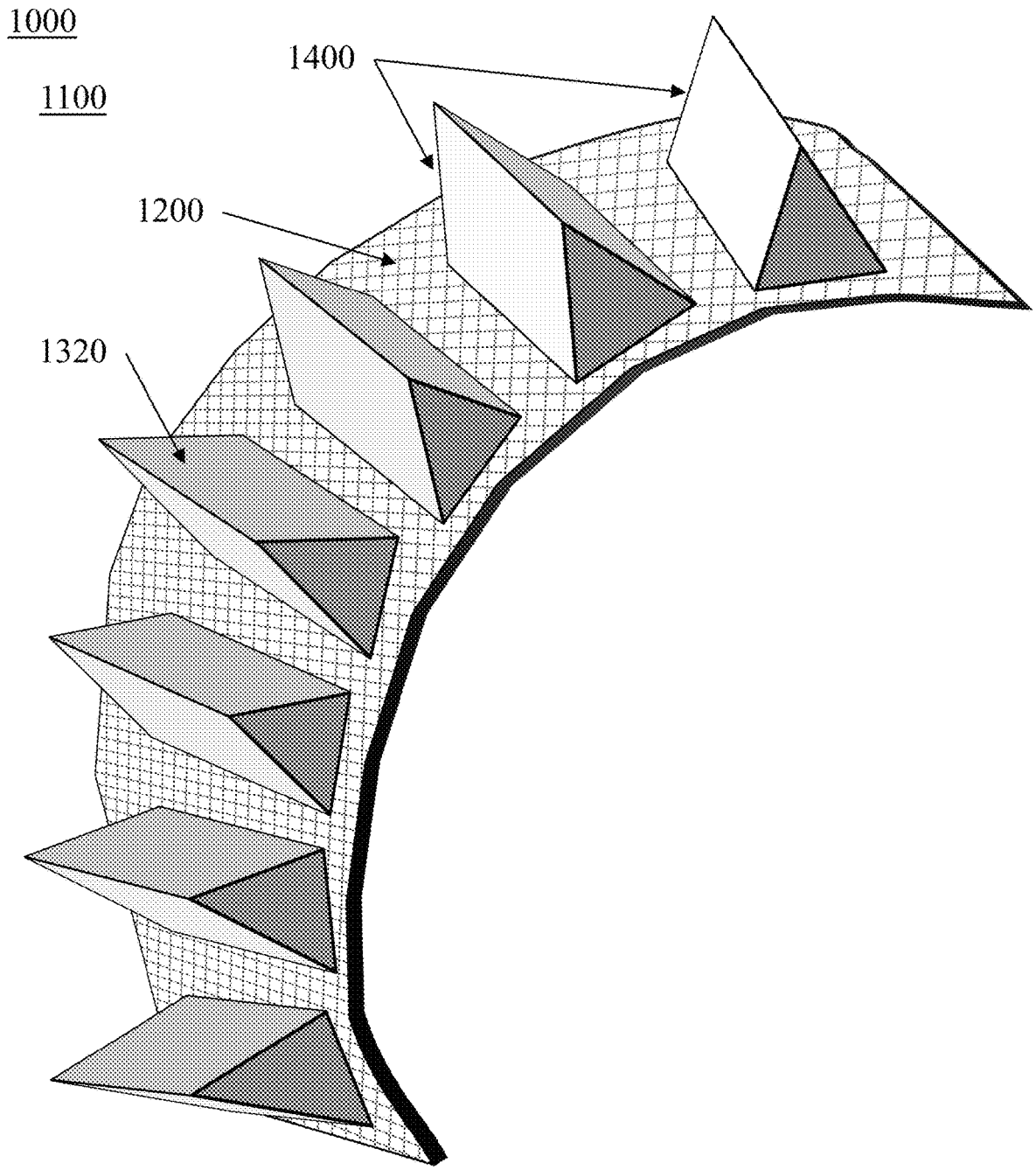
FIG. 10 is a perspective view of an exemplary embodiment of a system and/or device.

Referring to FIGS. 1-10, according to recent demographics studies, there are over 100,000 shoulder arthroscopies and 50,000 total shoulder replacements performed annually, in the United States alone, in addition to thorax surgeries, post mastectomies, and upper extremity procedures, as well as traumas that can require and/or benefit from skilled physical therapy services involving the shoulders and/or arms. During the rehabilitation process, improving the range of motion of the patient's shoulder can be the primary initial phase of therapy and/or can begin with a passive range of motion techniques. Those activities can transition to active assistance exercises and then to active range of motion exercises over the initial 4-8 weeks (depending on the severity and nature of the surgery and/or injury). Once active assistance exercises are permitted, a very common activity/exercise is "wall walking" and/or use of a stationary shoulder-finger ladder, which can involve the patient extending at least two fingers of one hand and moving those in a repeating sequence to "walk" those fingers up a series of ledges, thereby causing that patient's arm to gradually raise. This activity can gradually stretch and/or activate various muscles associated with the shoulder, which then can lead to improvements in its range of motion and/or active control.

Certain exemplary embodiments can assist with finger-walking by providing an over-the-door, non-destructively removable, portable, shoulder/finger-ladder system/device 1000.

Certain exemplary embodiments can provide a finger-ladder 1100 that is easy to set-up, easy to use, light, small enough to put in a suitcase or carry-on bag, and/or versatile enough to go over any human passage door 1300, including those of recreational vehicles.

Certain exemplary embodiments of finger-ladder 1000 can possess any of the following features:

1. Rolls up on itself for easy storage, transport, etc.;
2. Light weight (e.g., under approximately 1 pound);
3. Easily non-destructively releaseably secures to a door 1300, e.g., without creating holes in door 1300 and/or causing other cosmetic and/or structural damage, such as to the door 1300, door trim, and/or adjacent walls;
4. Able to open and close door 1300 without finger-ladder 1100 falling off;
5. Easily adjustable to any vertical position on door 1300 to meet an individual patient's/client's size and/or mobility impairments/issues;
6. As the patient/client improves, adjustable to higher on door 1300 to encourage and promote full range of motion;
7. Can fit on nearly any human passage door including those of recreational vehicles and can be taken on trips so that the patient is able to keep up with rehabilitation guidelines and continue to exercise while away from and/or unable to visit the physical therapy clinic and/or physical therapist; and/or
8. Can be included by home health and/or mobile clinicians with their mobile exercise equipment without the need of carrying a larger, bulkier finger-ladder to multiple homes on a given day.
9. Based on the patient's/client's needs, this shoulder-finger ladder can assist the patient's daily range-of-motion needs and/or improve compliance with their home exercise program.

Certain exemplary embodiments of finger-ladder 1100 can be constructed using an elongate strap 1200 that can define multiple elongate portions, such as a top portion 1210, a step portion 1220, and/or a bottom portion 1230, any of which can define a longitudinal axis and/or be formed from approximately 2-inch wide webbing. A plurality of elongate ladder steps/rungs 1400 can be attached to step portion 1220, which can measure from approximately 12 inches to approximately 72 inches in length. Ladder rungs

1400 can be formed from pieces of wooden and/or plastic wall trim, heat molded plastic, and/or 3-D printing. The rungs can be approximately 1.5 inches to approximately 3 inch wide and/or long pieces and/or can be attached to step portion 1220 with staples. Rungs 1400 can measure from approximately 0.5 to approximately 1.5 inch tall and/or deep, and/or can be separated by a vertical gap measuring approximately 0.25 inches to approximately 1 inch.

In certain exemplary embodiments, as desired and/or needed to rapid non-destructively removably and/or releasably secure finger-ladder 1100 to and/or in position on door 1300, one or more strap anchors 1240 generally can be configured to be attached to top portion 1210 and/or to bottom portion 1230. By anchoring both top portion 1210 and bottom portion 1230 to door 1300, finger-ladder 1100 can selectively retain a desired vertical and/or horizontal position on door 1300.

For example, a first strap anchor 1240, such as a strap hook 1246, can be attached to top portion 1210 and/or rest on top of and/or over the top of door 1300, thereby substantially anchoring top portion 1210 to door 1300. Similarly, a second strap hook 1247 can be attached to bottom portion 1230 and/or catch on and/or under the bottom of door 1300, thereby substantially anchoring bottom portion 1230 to door 1300.

Alternatively, a first strap knob loop 1244 can be attached to bottom portion 1230 and/or a second strap knob loop (not shown) can be attached to top portion 1210, each strap knob loop configured to slip over a door handle 1320 located on the opposite side of door 1300 from step portion 1220, thereby substantially anchoring bottom portion 1210 and/or 1230 to door 1300.

Alternatively, a strap stopper 1242, such as a bound coil of strap material, a ball, and/or a block, can be attached to top portion 1210 or bottom portion 1230 such that when door 1300 is closed, the strap stopper can prevent the strap portion to which it is connected from pulling through the gap between door 1300 and door frame 1340 or floor 1600, thereby substantially anchoring ladder strap, and/or the portion to which strap stopper 1242 is attached, to door 1300.

Alternatively, top portion 1210 can be connected to a first strap connector 1248 and bottom portion 1230 can be connected to a corresponding second strap connector 1248, the two strap connectors configured to mate and/or interconnect, thereby substantially anchoring top portion 1210 and bottom portion 1230 to each other and to door 1300.

To aid in providing adequate tension on ladder strap 1200 to keep it secured against and/or on door 1300, a strap variable length section 1260 and/or a strap length adjuster 1250 can be installed on and/or attached to top portion 1210 and/or bottom portion 1230.

In certain exemplary embodiments, the length of ladder strap 1200, top portion 1210, step portion 1220, and/bottom portion 1230 can be extended using a strap extender 1270, which can be formed from an additional length of strap material and/or webbing attached to ladder strap 1200, top portion 1210, step portion 1220, and/or bottom portion 1230, yet which need not be defined by the same width, thickness, and/or material as ladder strap 1200, top portion 1210, step portion 1220, and/or bottom portion 1230.

In certain exemplary embodiments, a first strap extender 1270 connected to top portion 1210 and a second strap extender 1270 connected to bottom portion 1230, each formed from an approximately 9 foot long by approximately 1-inch wide webbing, can be interconnected via one or more strap connectors 1248, such as a strap connector 1248.

In certain exemplary embodiments, the length of ladder strap 1200, top portion 1210, step portion 1220, and/bottom portion 1230 can be adjusted using a strap length adjuster 1250, which can be pull-tightened to securely hold finger-ladder 1100 to door 1300.

To aid in transporting finger-ladder 1100, once removed from door 1300, finger-ladder 1100 can be rolled on itself and/or secured in a roll configuration via strap connector 1248 and/or a buckle and/or a hook-and-loop fastener. Certain exemplary embodiments can provide a strap extension 1220, formed from, e.g., an additional approximately 6 inches of additional webbing, to extend over the top of the doorjamb if needed.

Each of the approximately 24 ladder steps/rungs 1400 can be positioned approximately ½" (approximately 10 mm) from the top to the step 1400 above. Certain exemplary embodiments can utilize heat moldable plastic and/or 3-D printing to construct any portion of the portable transportable shoulder-finger ladder system/device 1000.

In certain exemplary embodiments, ladder strap 1200 can be approximately 12 feet in length. Top portion 1210 can be approximately 3 foot long and/or can be stitched to the top of the approximately 2-inch wide step portion 1220, and/or can end with an interconnecting and/or female portion of strap connector 1248. Bottom portion 1230 can be approximately 9 feet long, can attach at the lowest part of the step portion 1220, and/or can end with an interconnecting and/or male section of strap connector 1248. The total length of an exemplary unwound finger-ladder 1100 can be approximately 14 feet.

The step portion 1220 of finger ladder 1100 can be approximately 36 inches long with approximately 24-26 steps 1400 that are approximately ¾" deep×approximately 2" wide and operatively positioned approximately 10 mm (approximately ½") apart vertically. Each step 1400 can be made from a synthetic wood trim, wood, plastic, heat molded polymer, and/or via 3-D printer. Each step 1400 can be secured to step portion 1220 by staples, rivets, small screws, glue, hook-and-loop fastener, and/or other securement/fastening means for stability.

In certain exemplary embodiments, any edge and/or surface of a step 1400, such as the top contact surface 1420, front surface, and/or bottom surface, can be smoothed to a predetermined surface roughness to avoid irritating the fingers during normal use, and/or roughened to a predetermined surface roughness to maximize the grip of the fingers, perhaps without irritation during normal use.

In certain exemplary embodiments, one or more steps 1400, step portion 1220, and/or strap 1200 can be labeled, such as with numbers, measurements, letters, words of praise, etc., so that the patient and caregiver can have an objective indication of starting and/or ending steps 1400 for a given session, thereby providing a mechanism for use instruction and/or performance measurement and/or determination associated with the finger walking exercises.

Because doors can be different heights, the labeling of steps 1400, strap 1200, and/or a separate fiducial, marked reference point, and/or labeling, such as a numerical and/or alphabetical scale marked on and/or attached to the strap 1200 and/or an attachment strap, can be configured for assisting with consistently and/or reliably positioning finger-ladder 1100 and/or one or more steps 1400 thereof at a desired vertical height and/or position on door 1300 and/or with respect to the floor 1600. For example, strap 1200 can be marked with a scale 1500 (shown using letters A, B, C, etc.) that can serve as a tape measure and/or position metric to provide a convenient means for correctly adjusting finger-ladder 1100 to a pre-determined position/height with respect to floor 1600 and/or door 1300. This ability for the user to position finger ladder 1100 at a consistent and objectively-determinable position and/or height can allow performance measurement integrity to be maintained from one exercise session to the next, even if between those exercise sessions finger-ladder 1100 is non-destructively removed from, and then non-destructively reinstalled on, a given door 1300 and/or non-destructively transferred to a different door 1300.

A single strap anchor 1240, or two or more cooperating strap anchors 1240, can non-destructively removably attach all or a portion of finger-ladder 1100 to door 1300. The wide variety of potential strap anchors can include, e.g., an over-the-door hook 1246 (much like a wreath holder), a strap connector 1248, such as a two-part plastic flat buckle 1248, a strap stopper 1242, such as a ball and/or a strap that is rolled on itself, and/or a strap knob loop 1244 that fits over door knob 1320.

Considering some of these types of strap anchors 1240 in more detail, one option to help stabilize finger-ladder 1100 to door 1300 can be a flat hook 1246 located at the top of ladder strap top portion 1210 that goes over door 1300 and/or a hook 1246 located at the bottom of ladder strap bottom portion 1230 that goes under door 1300.

As another example of a strap anchor 1240, a finger-ladder 1100 can be anchored to doorknob 1320 on the opposite side of door 1300, such as via a strap knob loop 1244, which can be connected, such as via stitching, to top portion 1210 and/or bottom portion 1230, and which can comprise at its opposite end from that connection a loop that can slip over doorknob 1320.

As yet another example of a strap anchor 1240, a strap connector 1248 (e.g., cam buckle, side-release buckle, center-release buckle, magnetic buckle, snap hook, flat hook, swivel hook, sling, ratchet, etc.) can be integral to and/or added to and/or near the loose ends of strap extensions 1260 such that opposing and/or cooperating strap connectors 1248 can connect to and/or via one another at the back of door 1300. The concept of a strap anchor can be considered relatively broadly to include even the loose end of a strap extension 1260. Such a strap anchor can be coupled with a D-ring, a cam buckle, or a strap ratchet (each of which can be considered to be a second strap anchor) such that the interaction and/or cooperation therebetween can secure strap 1200 to door 1300. Similarly, the mating and/or cooperating parts of, e.g., a side-release or center-release buckle, swivel hook and ring, and/or snap hook can be treated as interacting strap anchors.

At least one strap length adjuster 1250 (e.g., a strap adjuster, cord lock, D-ring, double D-ring, keeper, slide, etc.) can be integral to, inserted on, or non-destructively separable from strap connector 1248, and/or can be integral to or inserted on and/or non-destructively separable from the loose ends of strap extensions 1270, and/or can be configured to adjust the length of finger ladder 1100 and/or strap 1200. Once opposing strap extensions are connected to one another via strap connectors 1248, one can pull on one or both strap extensions 1270 to take out the slack in strap 1200 and/or finger ladder 1100 and/or to snug ladder 1100 to door 1300. Ladder 1100 can be adjusted and/or positioned on door 1300 at any operable height and/or horizontal position, such as to accommodate the needs of nearly any patient/client.

As another way of managing the length of strap 1200, top portion 1210 and/or bottom portion 1230 can be attached to a biasing member and/or a strap variable length section 1260, such as a strap-connected spring and/or an approximately 1-inch elastic strapping that can be stretched to lengthen for any sized door, thus allowing finger-ladder 1100 to remain on door 1300 and/or allow door 1300 to still be able to open and close without finger-ladder 1100 falling off of door 1300 and/or for strap 1200 to non-destructively maintain at least a predetermined tension force in the strap. Alternatively, top portion 1210 and/or bottom portion 1230 (and/or any strap extension attached thereto) can utilize a strap length adjuster 1250, via which top portion 1210 and/or bottom portion 1230 (and/or any strap extension attached thereto) can be tightened and/or loosened, thereby allowing ladder strap 1200 to be non-destructively, removably, snuggly attached to door 1300.

For individuals needing additional height, an addition, measuring between approximately 8 inches and approximately 12 inches, can be secured to the top of ladder 1100 by adding an additional solid piece measuring approximately 8 inches to 12 inches long with up to 8 stable ladder rungs. This solid piece can slide over the top to ladder rungs and/or can have a small metal or plastic down bent 90° angle that can slide between the top of the door jam trim and the wall to provide additional steps (e.g., 8 or more) above the door jam.

A jig, template, and/or grid (not shown) can be used for manual assembly of finger-ladder 1100, which can provide for consistent placement of steps 1400. The grid can be devised of approximately 24-26 slots to hold each of the approximately 24-26 ladder steps 1400 at approximately the desired spacing (e.g., approximately 10 mm). Once each step 1400 is located in its desired location, strap 1200 (which can be, e.g., approximately 2 inches wide) can be unrolled across the flat backs of steps 1400 and a staple gun can be used to insert staples, e.g., 3 staples, with 1 at the top center and 2 others at their desired locations (e.g., ¼ inch lower to the left and right, i.e., at approximately 45 degrees from the first staple) to secure steps 1400 to strap 1200 and/or 2-3 small inset screws can be applied for extra stability. Then, strap extensions 1270 (which can be formed from, e.g., an approximately 1 inch black webbing) can be hand sewn double and cross stitched to attach to the top approximately 1½ inches of top portion 1210 and/or lower approximately 1½ inches of bottom portion 1230 of strap 1200.

To use finger-ladder 1100, simply unconnect the connected members of non-destructively disconnectable strap connector 1248 (e.g., a buckle and/or hook-and-loop fastener) of strap 1200 and route the upper portion of strap 1200 over the top of door 1300 and the lower portion of strap 1200 under door 1300. Then connect the connectable members of strap connector 1248, adjust ladder 1100 on door 1300 to customize the starting point, and then pull the loose end of strap 1200 to tighten and snug ladder 1100 to door 1300. Finger-ladder 1100 can stay on door 1300 as long as needed and it need not interfere with the function of door 1300 or fall off of door 1300. Once finished with the use of finger-ladder 1100, simply unclip/unconnect strap connector 1248, roll ladder 1100 onto itself, and secure rolled ladder 1100 with an extra clip and/or Velcro tab for easy transport and storage.

Certain exemplary embodiments can provide a device comprising:

an elongate flexible strap defining an elongate top portion and an opposing elongate bottom portion connected to the top portion via an elongate step portion;

a plurality of elongate finger steps, each finger step from the plurality of finger steps attached to the step portion, a longitudinal axis of each finger step from the plurality of elongate finger steps oriented substantially perpendicularly with respect to a longitudinal axis of the step portion where that finger step attaches to the step portion;

a first strap anchor configured to non-destructively releasably secure the top portion to a door; and/or a second strap anchor configured to non-destructively releasably secure the bottom portion to the door;

wherein:

the strap is configured to be non-destructively coiled;

the longitudinal axis of each finger step from the plurality of elongate finger steps is operatively oriented substantially parallel with the longitudinal axis of each other finger step from the plurality of elongate finger steps;

the first strap anchor and the second strap anchor cooperatively non-destructively releasably secure the strap to the door;

the length of the strap is configured to be non-destructively adjustable; the first strap anchor is strap stopper having dimensions larger than a gap between the door and a doorframe in which the door is mounted;

the first strap anchor is strap stopper having dimensions larger than a gap between the door and a floor over which the door swings;

the first strap anchor is a strap knob loop configured to attach to the strap and to fit over a doorknob located on an opposite side of the door from the plurality of finger steps;

the first strap anchor is a hook configured to fit over a top of the door; the first strap anchor is a hook configured to fit over a bottom of the door; the first strap anchor is at least a portion of a first interconnecting strap connector that is configured to connect to a second interconnecting strap connector; the length of the strap is configured to non-destructively maintain a minimum tension force in the strap;

the length of the strap is configured to be extendable;

a finger contact surface of at least one finger step from the plurality of finger steps is configured to provide a predetermined surface roughness;

at least a portion of the steps from the plurality of finger steps are marked with a scale configured to standardize a height at which the plurality of finger steps are operatively mounted; and/or the step portion is marked with a scale configured to standardize a height at which the plurality of finger steps are operatively mounted.

Definitions

When the following phrases are used substantively herein, the accompanying definitions apply. These phrases and definitions are presented without prejudice, and, consistent with the application, the right to redefine these phrases via amendment during the prosecution of this application or any application claiming priority hereto is reserved. For the purpose of interpreting a claim of any patent that claims priority hereto, each definition in that patent functions as a clear and unambiguous disavowal of the subject matter outside of that definition.

a—at least one.

about—around and/or approximately.

above—at a higher level.

across—from one side to another.

activity—an action, act, step, and/or process or portion thereof.

adapt—to design, make, set up, arrange, shape, configure, and/or make suitable and/or fit for a specific purpose, function, use, and/or situation.

adapter—a device used to effect operative compatibility between different parts of one or more pieces of an apparatus or system.

adjustable—alterable, modifiable, and/or configured to change, match, and/or fit.

after—following in time and/or subsequent to.

along—through, on, beside, over, in line with, and/or parallel to the length and/or direction of; and/or from one end to the other of anchor—(v) to hold, fix, and/or secure; (n) a device adapted to hold, fix, and/or secure another.

and—in conjuction with.

and/or—either in conjunction with or in alternative to.

any—one, some, every, and/or all without specification.

apparatus—an appliance or device for a particular purpose.

approximately—about and/or nearly the same as.

are—to exist.

around—about, surrounding, and/or on substantially all sides of; and/or approximately.

as long as—if and/or since.

associate—to join, connect together, and/or relate.

at—in, on, and/or near.

at least—not less than, and possibly more than.

attach—to fasten, secure, couple, and/or join.

axis—a straight line about which a body and/or geometric object rotates and/or can be conceived to rotate and/or a center line to which parts of a structure and/or body can be referred.

between—in a separating interval and/or intermediate to.

bias—to influence in a particular direction.

biasing member—a device, such as a spring, that invokes a bias force on a object.

bottom—below relative to a predetermined orientation of an object.

by—via and/or with the use and/or help of can—is capable of, in at least some embodiments.

cause—to bring about, provoke, precipitate, produce, elicit, be the reason for, result in, and/or effect.

coil— (n) a continuous loop comprising two or more turns of electrically conductive material. (v) to roll and/or form into a configuration having a substantially spiraled cross-section.

composition of matter—a combination, reaction product, compound, mixture, formulation, material, and/or composite formed by a human and/or automation from two or more substances and/or elements.

comprising—including but not limited to.

conceive—to imagine, conceptualize, form, and/or develop in the mind.

configure—to design, arrange, set up, shape, and/or make suitable and/or fit for a specific purpose, function, use, and/or situation.

connect—to physically join, link, couple, and/or fasten two or more entities.

contact—to touch and/or come together.

containing—including but not limited to.

convert—to transform, adapt, and/or change.

cooperation—a joint operation and/or action.

cooperatively—done in cooperation with something else.

corresponding—related, associated, accompanying, similar in purpose and/or position, conforming in every respect, and/or equivalent and/or agreeing in amount, quantity, magnitude, quality, and/or degree.

coupleable—capable of being joined, connected, and/or linked together.

coupling—linking in some fashion.

create—to bring into being.
define—to establish the meaning, relationship, outline, form, and/or structure of;
and/or to precisely and/or distinctly describe and/or specify.
derive—to receive, obtain, and/or produce from a source and/or origin.
determine—to find out, obtain, calculate, decide, deduce, ascertain, and/or come to a decision, typically by investigation, reasoning, and/or calculation.
device—a machine, manufacture, and/or collection thereof
dimension—a measure of spatial extent, especially width, height, or length.
door—a movable structure used to close off an entrance, typically consisting of a panel that swings on hinges or that slides or rotates.
doorframe—a frame configured to structurally support a door so that the door can operatively move.
doorknob—a handle by which a door is opened and/or closed.
each—every one of a group considered individually.
effective—sufficient to bring about, provoke, elicit, and/or cause.
elongate—drawn out, made spatially longer, and/or having more length than width.
embodiment—an implementation, manifestation, and/or concrete representation.
estimate—(n) a calculated value approximating an actual value; (v) to calculate and/or determine approximately and/or tentatively.
exemplary—serving as an example, instance, and/or illustration.
extendable—able to lengthen, move out, and/or move away from.
finger—a digit of a human hand, especially one other than the thumb.
first—an initial element in a set.
fit—to be of the right size and/or shape for and/or conformable to a shape of
flexible—pliable and/or capable of bending without a tendency to break.
floor—a supporting surface of a structure.
for—with a purpose of.
force—a capacity to do work or cause physical change.
from—used to indicate a source, origin, and/or location thereof.
further—in addition.
gap—a space between objects.
generate—to create, produce, give rise to, and/or bring into existence.
given—that which is selected, indicated, and/or provided.
having—possessing, characterized by, comprising, and/or including, but not limited to.
height—a measurement of the extent of something along an, often substantially vertical, dimension.
hook—a curved or angular protrusion adapted to catch, pull, hold, and/or suspend something.
including—including but not limited to.
indicate—to show, mark, signal, signify, denote, evidence, evince, manifest, declare, enunciate, specify, explain, exhibit, present, reveal, disclose, and/or display.
initialize—to prepare something for use and/or some future event.
install—to connect or set in position and prepare for use.
interconnect—to be or become connected and/or interrelated.
into—to a condition, state, or form of
is—to exist in actuality.
knob—a doorknob.
larger—greater in magnitude.
length—a longest dimension of something and/or the measurement of the extent of something along its greatest dimension.
located—situated approximately in a particular spot and/or position.
longitudinal—of and/or relating to a length; placed and/or running lengthwise.
longitudinal axis—a straight line defined parallel to an object's length and passing through a centroid of the object.
loop—a length of strap that is curved or doubled over making an opening.
marked—denoted by a discernable symbol.
may—is allowed and/or permitted to, in at least some embodiments.
method—one or more acts that are performed upon subject matter to be transformed to a different state or thing and/or are tied to a particular apparatus, said one or more acts not a fundamental principal and not preempting all uses of a fundamental principal.
mount—(n) that upon which a thing is attached. (v) to couple, fix, and/or attach on and/or to something.
near—a distance of less than approximately [X].
no—an absence of and/or lacking any.
non-destructively—of, relating to, or being a process that does not result in damage to the subject items and/or materials, and/or results in such minimal damage that the subject items and/or materials can be re-used for its intended purpose.
one—being and/or amounting to a single unit, individual, and/or entire thing, item, and/or object.
operable—practicable and/or fit, ready, and/or configured to be put into its intended use and/or service.
operatively—in a manner able to function and/or to work.
opposing—opposite; against; being the other of two complementary or mutually exclusive things; placed or located opposite, in contrast, in counterbalance, across from something else and/or from each other; and/or aligned or positioned in an opposite direction from.
opposite—facing away from.
or—a conjunction used to indicate alternatives, typically appearing only before the last item in a group of alternative items.
orient—to position a first object relative to a second object.
other—a different and/or distinct entity and/or not the same as already mentioned and/or implied.
outside—beyond a range, boundary, and/or limit; and/or not within.
over—with reference to.
parallel—of, relating to, and/or designating lines, curves, planes, and/or surfaces everywhere equidistant.
per—for each and/or by means of.
perpendicular—intersecting at or forming substantially right angles.
plurality—the state of being plural and/or more than one.
portion—a part, component, section, percentage, ratio, and/or quantity that is less than a larger whole; can be visually, physically, and/or virtually distinguishable and/or non-distinguishable.

pre-—a prefix that precedes an activity that has occurred beforehand and/or in advance.
predetermine—to determine, decide, obtain, calculate, and/or establish in advance.
prevent—to hinder, avert, and/or keep from occurring.
prior—before and/or preceding in time or order.
product—something produced by human and/or mechanical effort.
project—to calculate, estimate, or predict.
provide—to furnish, supply, give, convey, send, and/or make available.
range—a measure of an extent of a set of values and/or an amount and/or extent of variation.
ratio—a relationship between two quantities expressed as a quotient of one divided by the other.
receive—to get as a signal, take, acquire, and/or obtain.
recommend—to suggest, praise, commend, and/or endorse.
reduce—to make and/or become lesser and/or smaller.
release—to free, detach, and/or cause the escape of a first item and/or material from a second item and/or material to and/or by which the first item is attached, bound, fastened, and/or held back.
remove—to eliminate, delete, detach, and/or to move from a place or position occupied.
repeat—to do again and/or perform again.
repeatedly—again and again; repetitively.
request—to express a desire for and/or ask for.
result—(n.) an outcome and/or consequence of a particular action, operation, and/or course; (v.) to cause an outcome and/or consequence of a particular action, operation, and/or course.
rough—having a surface marked by irregularities, protuberances, and/or ridges;
not smooth.
roughness—a measure of how rough a surface and/or edge is.
said—when used in a system or device claim, an article indicating a subsequent claim term that has been previously introduced.
scale—a system of ordered marks at fixed intervals used as a reference standard in measurement
secure—to fasten, connect, and/or prevent substantial relative movement of.
select—to make a choice or selection from alternatives.
set—a related plurality.
side—a surface of an object, especially a surface joining a top and bottom.
species—a class of individuals and/or objects grouped by virtue of their common attributes and assigned a common name; a division subordinate to a genus.
step—a stair and/or rung; one of a series of actions, processes, or measures taken to achieve a goal.
stopper—a device configured to halt movement of that to which it is attached.
store—to place, hold, and/or retain data, typically in a memory.
strap—a relatively thin band, having an elliptical, rectangular, and/or polygonal cross-section, and used for fastening and/or clamping one or more objects together and/or into position.
substantially—to a considerable, large, and/or great, but not necessarily whole and/or entire, extent and/or degree.
support—to bear the weight of, especially from below.
surface—the outer boundary of an object and/or a material layer constituting and/or resembling such a boundary.
swing—to move laterally and/or in a curve.
system—a collection of mechanisms, devices, machines, articles of manufacture, processes, data, and/or instructions, the collection designed to perform one or more specific functions.
tension—a deformation of an at least partially elastic body.
that—a pronoun used to indicate a thing as indicated, mentioned before, present, and/or well known.
that—used as the subject or object of a relative clause.
through—across, among, between, and/or in one side and out the opposite and/or another side of.
to—a preposition adapted for use for expressing purpose.
top—above relative to a predetermined orientation of an object.
transform—to change in measurable: form, appearance, nature, and/or character.
transmit—to send as a signal, provide, furnish, and/or supply.
treatment—an act, manner, or method of handling and/or dealing with someone and/or something.
upon—immediately or very soon after; and/or on the occasion of.
use—to put into service.
vertical—being and/or situated at a right angle to the horizon; upright.
via—by way of, with, and/or utilizing.
weight—a force with which a body is attracted to Earth or another celestial body, equal to the product of the object's mass and the acceleration of gravity; and/or a factor and/or value assigned to a number in a computation, such as in determining an average, to make the number's effect on the computation reflect its importance, significance, preference, impact, etc.
when—at a time and/or during the time at which.
where—in a situation and/or position.
wherein—in regard to which; and; and/or in addition to.
which—what particular one or ones; a pronoun adapted to be used in clauses to represent a specified antecedent.
with—accompanied by.
with regard to—about, regarding, relative to, and/or in relation to.
with respect to—about, regarding, relative to, and/or in relation to.
within—inside the limits of.
zone—a region and/or volume having at least one predetermined boundary.

NOTE

Various substantially and specifically practical and useful exemplary embodiments of the claimed subject matter are described herein, textually and/or graphically, including the best mode, if any, known to the inventor(s), for implementing the claimed subject matter by persons having ordinary skill in the art. References herein to "in one embodiment", "in an embodiment", or the like do not necessarily refer to the same embodiment.

Any of numerous possible variations (e.g., modifications, augmentations, embellishments, refinements, and/or enhancements, etc.), details (e.g., species, aspects, nuances, and/or elaborations, etc.), and/or equivalents (e.g., substitutions, replacements, combinations, and/or alternatives, etc.) of one or more embodiments described herein might become apparent upon reading this document to a person having ordinary skill in the art, relying upon his/her expertise and/or knowledge of the entirety of the art and without exercising undue experimentation. The inventor(s) expects any person having ordinary skill in the art, after obtaining authorization from the inventor(s), to implement such variations, details, and/or equivalents as appropriate, and the inventor(s) therefore intends for the claimed subject matter to be practiced other than as specifically described herein. Accordingly, as permitted by law, the claimed subject matter includes and covers all variations, details, and equivalents of that claimed subject matter. Moreover, as permitted by law, every combination of the herein described characteristics, functions, activities, substances, and/or structural elements, and all possible variations, details, and equivalents thereof, is encompassed by the claimed subject matter unless otherwise clearly indicated herein, clearly and specifically disclaimed, or otherwise clearly unsuitable, inoperable, or contradicted by context.

The use of any and all examples, or exemplary language (e.g., "such as") provided herein, is intended merely to better illuminate one or more embodiments and does not pose a limitation on the scope of any claimed subject matter unless otherwise stated. No language herein should be construed as indicating any non-claimed subject matter as essential to the practice of the claimed subject matter.

Thus, regardless of the content of any portion (e.g., title, field, background, summary, description, abstract, drawing figure, etc.) of this document, unless clearly specified to the contrary, such as via explicit definition, assertion, or argument, or clearly contradicted by context, with respect to any claim, whether of this document and/or any claim of any document claiming priority hereto, and whether originally presented or otherwise:

- there is no requirement for the inclusion of any particular described characteristic, function, activity, substance, or structural element, for any particular sequence of activities, for any particular combination of substances, or for any particular interrelationship of elements;
- no described characteristic, function, activity, substance, or structural element is "essential"; and
- within, among, and between any described embodiments:
  - any two or more described substances can be mixed, combined, reacted, separated, and/or segregated;
  - any described characteristic, function, activity, substance, component, and/or structural element, or any combination thereof, can be specifically included, duplicated, excluded, combined, reordered, reconfigured, integrated, and/or segregated;
  - any described interrelationship, sequence, and/or dependence between any described characteristics, functions, activities, substances, components, and/or structural elements can be omitted, changed, varied, and/or reordered;
  - any described activity can be performed manually, semi-automatically, and/or automatically;
  - any described activity can be repeated, performed by multiple entities, and/or performed in multiple jurisdictions.

The use of the terms "a", "an", "said", "the", and/or similar referents in the context of describing various embodiments (especially in the context of the following claims) are to be construed to cover both the singular and the plural, unless otherwise indicated herein or clearly contradicted by context.

The terms "comprising," "having," "including," and "containing" are to be construed as open-ended terms (i.e., meaning "including, but not limited to,") unless otherwise noted.

When any number or range is described herein, unless clearly stated otherwise, that number or range is approximate. Recitation of ranges of values herein are merely intended to serve as a shorthand method of referring individually to each separate value falling within the range, unless otherwise indicated herein, and each separate value and each separate sub-range defined by such separate values is incorporated into the specification as if it were individually recited herein. For example, if a range of 1 to 10 is described, that range includes all values therebetween, such as for example, 1.1, 2.5, 3.335, 5, 6.179, 8.9999, etc., and includes all sub-ranges therebetween, such as for example, 1 to 3.65, 2.8 to 8.14, 1.93 to 9, etc., even if those specific values or specific sub-ranges are not explicitly stated.

When any phrase (i.e., one or more words) appearing in a claim is followed by a drawing element number, that drawing element number is exemplary and non-limiting on claim scope.

No claim or claim element of this document is intended to invoke 35 USC 112(f) unless the precise phrase "means for" is followed by a gerund.

Any information in any material (e.g., a United States patent, United States patent application, book, article, web page, etc.) that has been incorporated by reference herein, is incorporated by reference herein in its entirety to its fullest enabling extent permitted by law yet only to the extent that no conflict exists between such information and the other definitions, statements, and/or drawings set forth herein. In the event of such conflict, including a conflict that would render invalid any claim herein or seeking priority hereto, then any such conflicting information in such material is specifically not incorporated by reference herein. Any specific information in any portion of any material that has been incorporated by reference herein that identifies, criticizes, or compares to any prior art is not incorporated by reference herein.

Applicant intends that each claim presented herein and at any point during the prosecution of this application, and in any application that claims priority hereto, defines a distinct patentable invention and that the scope of that invention must change commensurately if and as the scope of that claim changes during its prosecution. Thus, within this document, and during prosecution of any patent application related hereto, any reference to any claimed subject matter is intended to reference the precise language of the then-pending claimed subject matter at that particular point in time only.

Accordingly, every portion (e.g., title, field, background, summary, description, abstract, drawing figure, etc.) of this document, other than the claims themselves and any provided definitions of the phrases used therein, is to be regarded as illustrative in nature, and not as restrictive. The scope of subject matter protected by any claim of any patent that issues based on this document is defined and limited only by the precise language of that claim (and all legal equivalents thereof) and any provided definition of any phrase used in that claim, as informed by the context of this document when reasonably interpreted by a person having ordinary skill in the relevant art.

What is claimed is:

1. A device, comprising:

an elongate flexible strap defining an elongate step portion;

a plurality of elongate finger steps, each elongate finger step from the plurality of elongate finger steps attached to the elongate step portion, a longitudinal axis of each elongate finger step from the plurality of elongate finger steps oriented substantially perpendicularly with respect to a longitudinal axis of the elongate step portion where that elongate finger step attaches to the elongate step portion; and a first strap anchor configured to non-destructively releasably secure the elongate flexible strap to a door;

wherein:

the elongate flexible strap is configured to be non-destructively coiled;

the longitudinal axis of each elongate finger step from the plurality of elongate finger steps is operatively oriented substantially parallel with the longitudinal axis of each other elongate finger step from the plurality of elongate finger steps; and for each elongate finger step from the plurality of elongate finger steps, a top exposed finger contact surface of that elongate finger step operatively extends substantially perpendicularly from a plane operatively defined by the elongate step portion and is operatively configured for direct contact with a finger of a patient.

2. The device of claim 1, further comprising:

a second strap anchor configured to non-destructively releasably secure the elongate flexible strap to the door.

3. The device of claim 1, wherein:

the first strap anchor and a second strap anchor non-destructively releasably secure the elongate flexible strap to the door.

4. The device of claim 1, wherein:

a length of the elongate flexible strap is configured to be non-destructively adjustable.

5. The device of claim 1, wherein:

the first strap anchor comprises a strap stopper having a height that is greater than a height of a vertical gap between the door and a doorframe in which the door is mounted.

6. The device of claim 1, further comprising:

a second strap anchor that comprises a strap stopper having a height that is greater than a height of a vertical gap between the door and a floor over which the door swings.

7. The device of claim 1, wherein:

the first strap anchor comprises a strap doorknob loop configured to attach to the elongate flexible strap and to fit over a doorknob located on an opposite side of the door from the plurality of elongate finger steps.

8. The device of claim 1, wherein:

the first strap anchor comprises a hook configured to fit over a top of the door and/or a bottom of the door.

9. The device of claim 1, wherein:

the first strap anchor is configured to interconnect with a second strap anchor.

10. The device of claim 1, wherein:

a biasing member is configured to generate a tension force in the elongate flexible strap.

11. The device of claim 1, wherein:

a length of the elongate flexible strap is configured to be extendable.

12. The device of claim 1, wherein:

the top exposed finger contact surface of at least one elongate finger step from the plurality of elongate finger steps is configured to provide a predetermined surface roughness.

13. The device of claim 1, wherein:

at least a portion of the elongate finger steps from the plurality of elongate finger steps are marked with a scale configured to indicate a height at which the plurality of elongate finger steps are operatively mounted on the door.

14. The device of claim 1, wherein:

the elongate step portion is marked with a scale configured to indicate a height at which the plurality of elongate finger steps are operatively mounted on the door.

* * * * *